United States Patent [19]

Paton et al.

[11] 4,194,333

[45] Mar. 25, 1980

[54] ATTACHMENT FOR MOUNTING CONCRETE WALL PANELS ON A BUILDING

[75] Inventors: W. Donald Paton, Aurora; Thomas W. Steenson, Richmond Hill, both of Canada

[73] Assignee: Butler Manufacturing Company, Kansas City, Mo.

[21] Appl. No.: 908,965

[22] Filed: May 24, 1978

[51] Int. Cl.[2] ..... E04B 1/41

[52] U.S. Cl. ..... 52/235; 52/489; 52/709; 52/486; 52/713; 52/710

[58] Field of Search ..... 52/486, 489, 713, 710, 52/235, 712, 704, 709, 432, 434

[56] References Cited

U.S. PATENT DOCUMENTS

| | | | |
|---|---|---|---|
| 1,511,764 | 10/1924 | Jordahl | 52/710 |
| 1,854,633 | 4/1932 | Stephens | 52/713 |
| 2,480,241 | 8/1940 | Hensel | 52/486 |
| 3,248,836 | 5/1966 | Monk et al. | 52/235 |

FOREIGN PATENT DOCUMENTS

| | | | |
|---|---|---|---|
| 399,581 | 10/33 | Great Britain | 52/709 |

ABSTRACT

An attachment for attaching a precast concrete wall panel to a building in a manner which permits vertical movement of that wall panel relative to building structural elements. In one embodiment, the attachment includes inserts embedded in the wall panel near the top and bottom edges of the upright wall panel, a tongue element connecting the top inserts to a building beam, or the like, and a clamp attached to the bottom inserts to connect those inserts to a building foundation. The inserts have slots defined therein in which portions of the tongue and clamp are located to permit the wall panel and building to move vertically with respect to each other.

8 Claims, 9 Drawing Figures

FIG. 3.
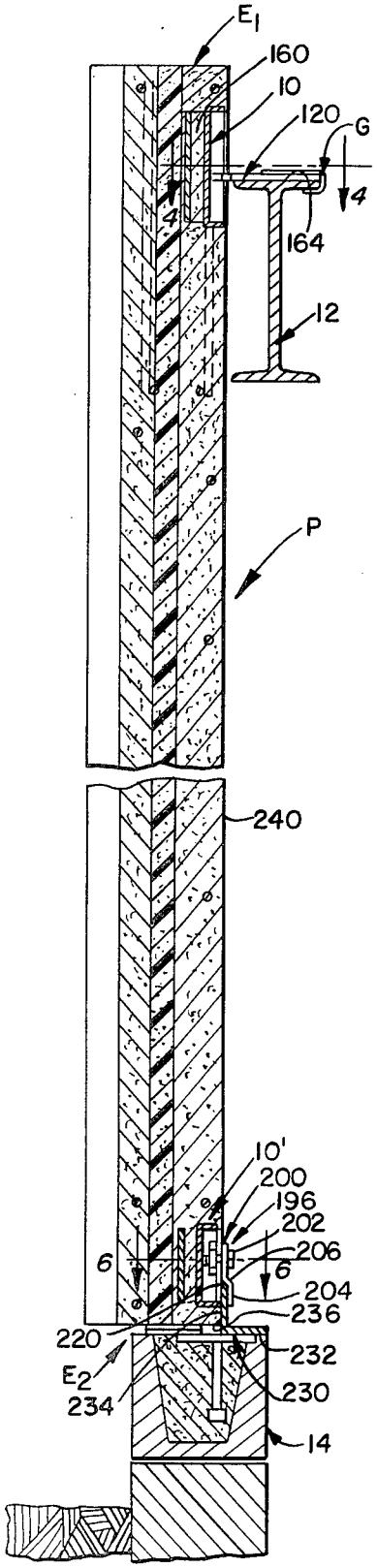
FIG. 4.
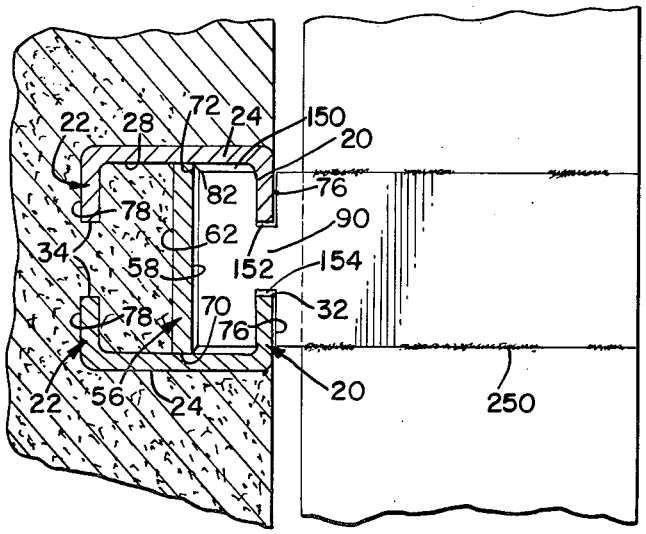
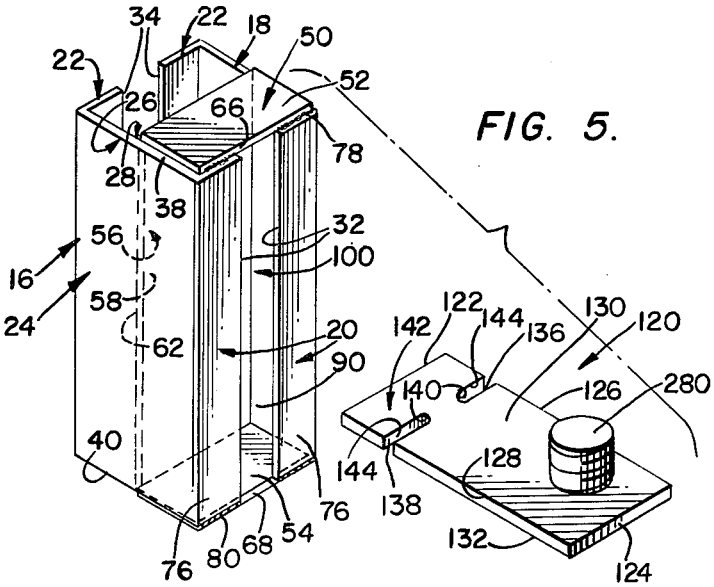
FIG. 5.
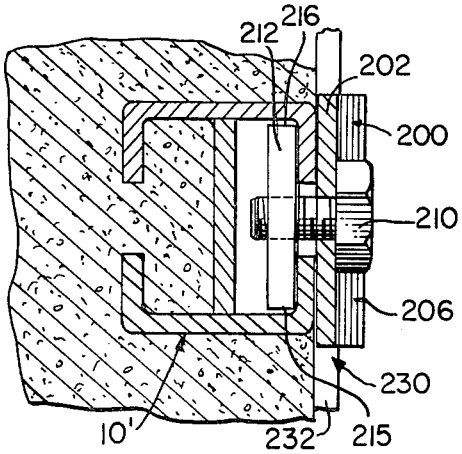
FIG. 6.

ATTACHMENT FOR MOUNTING CONCRETE WALL PANELS ON A BUILDING

BACKGROUND OF THE INVENTION

The present invention relates in general to concrete building panels, and, more particularly, to means for attaching concrete building panels to buildings.

Precast concrete wall panels are being widely used in the building industry and can be custom made, which may prove to be very expensive and inefficient, or can be formed in an automated process. A panel formed by an automated process is disclosed in U.S. patent application Ser. No. 811,300, filed Jan. 29, 1977.

As use of precast concrete wall panels increases, the method and means for attaching those panels to building structures becomes more important. Such attaching means should attach the wall panel to a building in an efficient manner, yet in a manner which is secure enough to safely withstand all of the stresses to which a building is subject. Therefore, in addition to the usual criteria, the following criteria should be met by the means used to attach precast concrete wall panels to buildings in modern buildings: (1) during the manufacturing process, the attaching means should be attachable to a form by the use of double faced tape, or the like, but in any event, in a manner which does not require that holes be drilled in steel forms; and (2) the attaching means should have a shear capacity sufficient to transfer roof diaphragm shear to the wall panels.

A further important consideration in modern building construction involves movement of building elements relative to each other. Such relative movement may occur due to normal building settling in any geographic area, but is an especially important factor in areas having the possibility of earthquakes, or so-called seismic zones.

Such relative movement can be accounted for in the wall panel assemblies simply by making the wall panel attachment means strong enough to overcome the forces developed under such conditions. However, such a method can be very expensive and still not adequately account for the relative movement.

Furthermore, the means used to attach wall panels to buildings should have a capacity to account for production, erection and job site tolerances.

There are many different devices known for attaching concrete wall panels to buildings. For example, one device includes a weld plate cast into the concrete panel which is then welded rigidly to the building structure at the time of erection. While this type of device is suitable for custom-type panels which permit accurate placement of weld plates in predetermined positions, such a device is not suitable for concrete panels made on a production automated long line system, nor are production, erection or job site tolerances adequately accommodated by such a device.

The inventor is also aware of hanger devices suitable for concrete work. Examples of such hanger devices are disclosed in U.S. Pat. Nos. 1,201,540, 1,924,884, 1,933,536 and 1,491,571. However, none of these devices are suitable for supporting a concrete building panel on a building in a manner which satisfies all of the above-stated requirements, nor are any of these devices even suitable for supporting a concrete wall panel, such as those used in modern buildings, on a building. Other devices used in building construction are disclosed in U.S. Pat. Nos. 1,548,214 and 2,133,134.

Thus, the known devices are not disclosed, nor suitable for use in attaching a precast concrete wall panel formed in an automated long line process to a building in a manner which accommodates movement of building elements relative to each other, and especially such relative movement induced in seismic zones. Such seismic zone relative movement may be quite severe, and thus should be accounted for, but heretofore has been essentially overlooked.

SUMMARY OF THE INVENTION

The wall panel attachment means embodying the teachings of the present invention is easily fabricated and is easily incorporated into a precast wall panel formed in an automated long line process. The means is expeditious to use and accommodates movement of the building and wall panel with respect to each other while mounting the wall panel to the building in a manner which is secure enough to accept high stresses induced therein by building and/or earthquake forces. The connections disclosed herein are intended for use on any type of a building, including steel conventional, steel pre-engineered, or concrete beam column and double-T structure-type buildings, among others.

The attachment means includes inserts embedded in the panel. Each insert includes a pair of bent plates of the same shape and size and a third plate which is a spacer and which is shaped in a manner similar to the first two plates. The spacer is attached to the first two plates so that the three elements define on one side of the spacer a chamber which is closed to prevent concrete from penetrating thereinto, and on the other side of the spacer a passage which is open to accept concrete for embeddedly mounting the insert in the wall panel.

The inserts are located near the edges of the wall panel which form the top and bottom edges thereof when the panel is oriented in an upright position. A tongue element is used to attach the top inserts to a building beam, and a clamp is used to attach the bottom inserts to a building foundation, such as a footing or the like. The clamp is attached to the insert by a fastener. It is also noted that the clamp attachment may also be used at the top of the panel in place of the tongue attachment, and is illustrated and described herein at the bottom of a panel only for the sake of convenience. Furthermore, the tongue allows for alignment of the panels independently of the building structurals. However, it is to be understood that the clamp attachment may also be used at the top of the panel without departing from the teachings of the present disclosure.

The inserts have slots defined therein to which the tongue and clamp fasteners are attached. The tongue is received in a slot in a sliding manner and thus can move vertically within the slot after the wall panel is erected and attached to a building. The tongue moves in the slot, but when the clamp fastener is used at the top of the panel, the clamp is bolted tight and the relative movement is between the clamp which is securely attached to the panel and a bracket mounted on the structure which is slidably engaged by the tie plate of the clamp. Thus, relative vertical movement between the building structural elements and the attached wall panel is permitted while the wall panel remains securely attached to that building.

When installed on a building, the movement is primarily temperature related, i.e., if the panel is restrained at the top, then it will bow outwardly under the effects of temperature. The outside face expands when heated and the attachment permits unrestrained movement without unacceptable consequences.

The inserts are thus self-anchoring in the wall panel due to the presence of concrete in the passage defined in the insert, and no welding, or the like, is required to attach the inserts to the wall panel. The only welding that is required is that welding used to hold the three plates together, so that the tongue or the clamp can be located near the ends of the unit and still possess the proper load bearing capacity. It is noted that the channel-shaped elements that form the slotted insert arrangement are welded together top and bottom for two reasons, firstly, to hold elements together, and secondly, so that the 10,000 lbs. ultimate pull-out capacity of this insert can be developed when the tongue is located at any point in the insert, such as, for example, at the top, the bottom, or the center of the insert.

The attachment means of the present invention is anchored in the wall panel securely enough to withstand pullout forces generated in seismic zones of nearly 10,000 pounds per insert, and have a shear capacity sufficient to transfer roof diaphragm stress to the wall panels of up to 14,000 pounds, while still permitting unrestrained vertical movement of the wall.

By allowing relative vertical movement, the attachment means of the present invention permits vertical relief without stress buildup, so that stresses developed in insulated wall panels do not cause excessive bowing of those wall panels.

The attachment means is easily and quickly attached to building structural elements without requiring the drilling of holes in steel beams, as the tongue can be welded or otherwise similarly attached to a beam, and the clamp can be jammed about a bracket or the like.

In addition to providing for vertical movement and fast erection techniques, the tongue-type connection also allows the panels to be aligned independently of the alignment of the building structurals. Usually, a 1 inch gap is provided for this purpose. On the other hand, on buildings which are accurately erected, it is convenient to use a clamp-type connection at the top of the panel.

The means of the present invention is adjustable vertically for providing tolerances to account for production tolerances, erection tolerances and job site tolerances. It is to be noted that the relative movement which occurs in a finished structure is relatively small. Thus, the size of the slotted inserts (4" to 6") primarily accommodates construction and fabrication tolerances in mass produced panels. On double-T structures, the vertical adjustment is also needed to provide for the chamber variations of double-T members.

Due to the simplicity thereof, the attachment means of the present invention is expeditiously and economically fabricated and incorporated into a wall panel.

The inserts need not be located near any prestressing strands, and no additional reinforcing steel need be added to the panel. The inserts have their own anchorages and thus do not require any additional reinforcing means. Some heavy duty inserts can, however, be used to chair up prestressing strands.

OBJECTS OF THE INVENTION

It is, therefore, a main object of the present invention to attach a wall panel to a building in a manner which permits relative vertical movement between the panel and building structural elements.

It is another object of the present invention to provide a wall panel attachment means suitable for use in precast concrete wall panels formed in an automated long line production process.

It is a further object of the present invention to provide a wall panel attachment means suitable for use in seismic zones for transmitting roof diaphragm shear forces.

It is yet another object of the present invention to provide a wall panel attachment means that need not be welded to a building in a rigid manner.

It is yet a further object of the present invention to provide a wall panel attachment means having a shear capacity sufficient so that roof diaphragm shear can be safely transferred to wall panels while permitting essentially unrestrained vertical movement of the insulated wall.

It is still a further object of the present invention to provide a wall panel attachment means which can be attached to a form without requiring the drilling of holes in steel forms.

These together with other objects and advantages which will become subsequently apparent reside in the details of construction and operation as more fully hereinafter described and claimed, reference being had to the accompanying drawings forming part hereof, wherein like reference numerals refer to like parts throughout.

BRIEF DESCRIPTION OF THE DRAWINGS

FIG. 3 is a section view taken along line 3—3 of FIG. 1.

FIG. 4 is a plan view taken along line 4—4 of FIG. 3.

FIG. 5 is a perspective of a top insert embodying the teachings of the present invention.

FIG. 6 is a plan view taken along line 6—6 of FIG. 3.

DETAILED DESCRIPTION OF THE INVENTION

Figure 1:
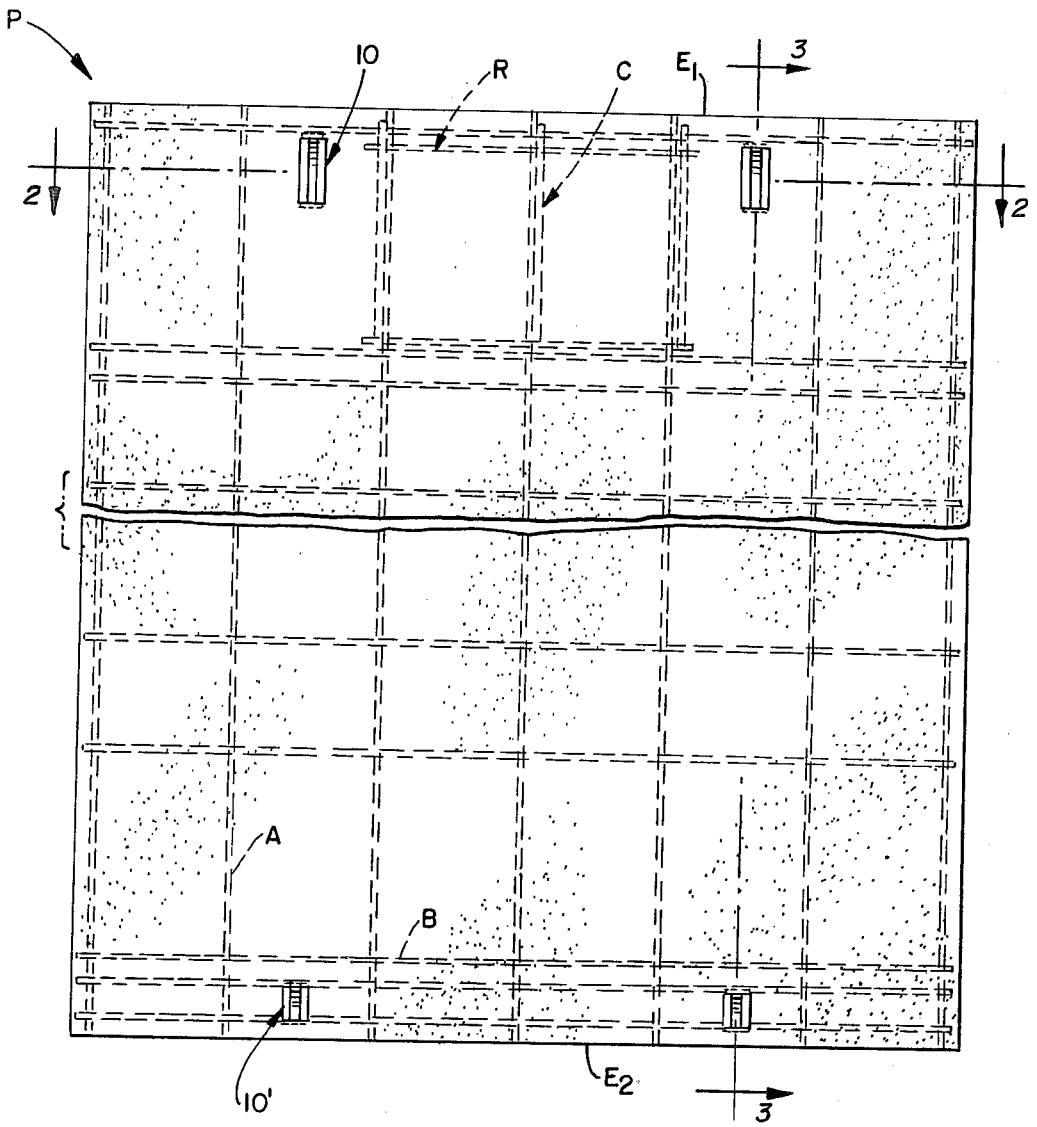
FIG. 1 is an elevation view of a wall panel using attachment means embodying the teachings of the present invention.
Figure 2:
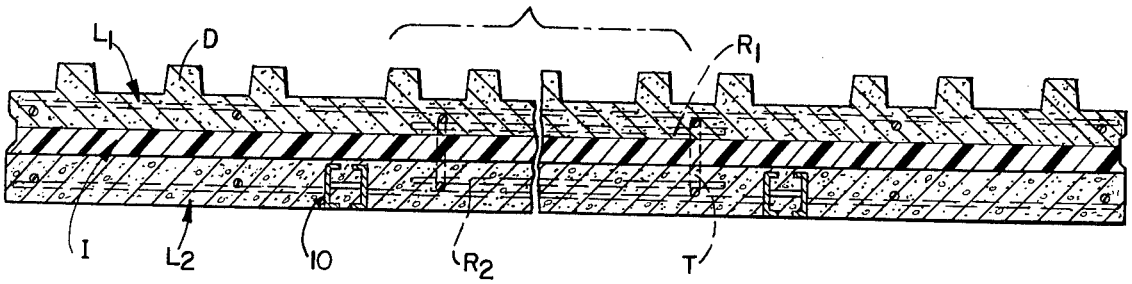
FIG. 2 is a section view taken along line 2—2 of FIG. 1.

Shown in FIG. 1 is a wall panel P which has preferably been formed in an automated long line production process. The panel may be precast concrete or the like, and, as shown in FIG. 2, includes an optional layer I of insulating material sandwiched between an outer layer $L_1$ and an inner layer $L_2$ of concrete. The panels may also be other than insulated panels, for example, solid panels can be used, without departing from the scope of the present invention. Insulated panels are here disclosed only for the sake of convenience, and such disclosure is not intended to be restrictive. The panel includes connectors C having rods $R_1$ and $R_2$ embedded in both the outer and inner layers, respectively, and tie rods T connecting the rods $R_1$ and $R_2$ together and extending through the insulation layer. The connectors are used for erecting panels. Shear connectors, such as disclosed in pending U.S. application Ser. No. 811,300, filed Jan. 29, 1977, can also be used in the panel P. The panel P is longitudinally reinforced by reinforcing strands A and is transversely reinforced by reinforcing strands B which may be prestressed rods, or the like. It is noted that the disclosure of reinforcing strands may imply prestressed panels. However, the present disclosure is not limited to prestressed panels, but other panels can also be used without departing from the scope of the present invention. As shown in FIG. 2, decorative ribs D may be located on the outer surface of panel outer layer $L_1$ and extend longitudinally thereof.

The panel P also includes an attaching means for attaching that panel to a building. The attaching means includes a plurality of first inserts 10 attaching the panel to a building structural element, such as beam 12, and a plurality of second inserts 10' for attaching the panel to a foundation, such as footing or foundation wall 14 shown in FIG. 3.

The inserts 10 and 10' are identical and thus only insert 10 will be described, it being understood that the description applies equally to the insert 10'.

The insert 10 is shown in FIGS. 4 and 5 and includes a pair of elongate unitary side members 16 and 18, each being in the form of a block U and each having a pair of legs 20 and 22 integrally connected together by bight section 24 which has an outer surface 26 and an inner surface 28. The legs 20 and 22 have longitudinal side edges 32 and 34, respectively, and the side members each has a pair of end edges 38 and 40 which form the top and bottom edges of a vertically oriented insert. The side edges 32 and 34 can also be rounded, if desired. As shown in FIG. 5, the side members are in opposed spaced relationship. As shown in FIG. 4, legs 22 are presented toward each other, however, a heavy duty insert will include legs 22 which are presented away from each other, i.e., legs 22 will each extend outwardly and away from the longitudinal centerline of the insert in a direction opposite the direction shown in FIGS. 4 and 5. It is noted that the slot in the tongue is rounded for two reasons, one, because rounded edges are easy to fabricate, and two, because a rounded neck section is stronger than a square net section, and a rounded configuration also tends to reduce any notch effect. A greater pull-out capacity is possible with the rounded slot vis-a-vis a square slot.

The insert 10 also includes an elongate unitary spacer member 50 which is in the form of a block U and which has a pair of legs 52 and 54 integrally connected together by a bight section 56. The bight section has an inner surface 58 and an outer surface 62. The legs 52 and 54 have longitudinal side edges 66 and 68, respectively, and the spacer member has end edges 70 and 72.

As shown in FIGS. 4 and 5, the side members 16 and 18 are oriented in side edge opposed relationship with the side edges 32 and 34 of member 16 and in facially opposed relationship with corresponding side edges 32 and 34 of member 18. As shown in FIG. 5, the side members are paired, that is, identical, and are oriented to be coextensive with the end edges thereof, and the outer surfaces 76 and 78 of the legs of side member 16 being coplanar with the corresponding outer surfaces 76 and 78 of side member 18.

The spacer member 50 is interpositioned between the side members 16 and 18 and the end edges 70 and 72 connect inner surfaces 28 of the side members, and side edges 66 and 68 of the spacer member are offset from the plane containing the side member leg outer surfaces 76 and are attached thereto, as by welds 78 and 80.

As shown in FIG. 5, the bight sections 24 of the side members have a width, as measured between the legs 20 and 22 of the side members, which exceeds the length of the spacer member legs, as measured between the spacer member bight section 56 and the side edges 66 and 68 thereof. As is also shown in FIG. 5, the length of the spacer member bight section, as measured between the end edges 70 and 72 thereof, exceeds the combined width of the side member legs, as measured between the side member bight section 24 and the side member longitudinal side edges 32 and 34, so that, with the spacer member interpositioned between the side members as in FIGS. 4 and 5, the corresponding opposed side member side edges define an elongate slot 90 therebetween.

The spacer member is edge attached, as by welding, such as weld 82, to the confronting inner surfaces of the side member bight sections, and, as aforementioned, the legs 20, 52 and 54 of the three members are also attached together by welding the legs 52 and 54 to the end edges 38 and 40 of the side member legs 20 by the welds 78 and 80 to hold the elements together and develop the strength of the tongue, even when that tongue is located at the top or bottom extremity of the insert.

As shown in FIG. 5, the connected members form a chamber 100 defined by the legs 20, 52 and 54, bight section 56 and part of the bight sections 24. The chamber 100 is closed except for the slot 90 which defines an entranceway into that chamber. The purpose of the form of the insert will be discussed below.

As shown in FIGS. 1 and 3, the panel P has end edges $E_1$ and $E_2$ which form the top and bottom end edges, respectively, in an upright panel. A plurality of colevel spaced apart inserts are located near each of the edges $E_1$ and $E_2$ as shown in the figures. The inserts are all identical, the clamps can be used on the top of the panel, and the tongues can be used elsewhere, but for the sake of convenience, the first inserts 10 will be considered to be those inserts located near top forming edge $E_1$ and will hereinafter be identified as "top inserts", and the second inserts 10' will be considered to be those inserts located near the bottom forming edge $E_2$ and will hereinafter be identified as "bottom inserts".

The top inserts are attached to a building beam 12 by an elongate tongue element 120 which is uniplanar and which includes end edges 122 and 124 and side edges 126 and 128 as well as facial surfaces 130 and 132. A pair of colinear guide slots 136 and 138 are defined in the tongue element nearer to one end edge, such as edge 122, than to the other end edge, and which extend transversely of the tongue element toward each other, and each of which terminates in a bottom edge 140. When the housing side edges 32 and 34 are rounded, the tongue slot bottom edges 140 may be similarly rounded to correspond thereto. The tongue therefore has a head section 142 defined between the colinear guide slot and the tongue end edge 122. It is noted that the edges 140 may be rounded to strengthen the net section of the tongue and thereby minimize the notch effect, the rounded edges also simplifying tongue fabrication.

As best shown in FIG. 4, each slot has a depth, as measured between the tongue side edges 126 or 128 and the slot bottom edge 140, which is nearly equal to the width of the side member legs, and the length of the tongue head section 142 as measured between the end edge 122 and the front edges 144 of the guide slots is slightly less than the depth of the chamber 100 as measured between the spacer member bight section inner surface and the inner surfaces of the side member legs 20. The front edges 144 of the slot shown in FIG. 5 are rounded to indicate the alternative nature of the edges 32. It is noted, however, that the shapes of edges 32 and 144 can correspond to each other if desired. As is evident by comparing FIGS. 4 and 5, the width of the slot 90, as measured between the opposed edges 32, exceeds the thickness of the tongue as measured between the tongue facial surfaces 130 and 132, so that the tongue head 142 is easily inserted into the chamber 100 by aligning the tongue facial surfaces with the planes containing the slot defining edges 32, aligning the slots 136 and 138 with the legs 20, and twisting the tongue so that the side member legs and slots are in registry as shown in FIG. 4. Due to the sizing of the elements, the tongue head section is easily accommodated in the chamber 100 with a peripheral clearance space 150 defined between the chamber inner surfaces and the perimeter of the tongue, and gaps 152 and 154 defined between the slot defining edges 32 and the slot bottom edges 140. Furthermore, there is some clearance between the slot side edges and the facial surfaces of the slot defining legs. Such clearance spaces and gaps permit the tongue to move longitudinally of the insert elongate slot 90 to accommodate relative vertical movement between the wall panel P and the building beam 12.

The size of the chamber 100 relative to the side members thus defines an open passage 160 behind the chamber. As shown in FIGS. 3 and 4, when the insert is embedded in the panel, concrete flows into and fills passage 160 to thereby fixedly mount the insert in the panel, while such concrete is precluded from entering into the chamber 100 by the closed nature of that chamber.

To attach a panel to beam 12 via the insert 10, tongue head section 142 is inserted into chamber 100, and the slots 136 and 138 are registered with the slot defining edges 32 of the side member legs. The facial surface 132 of the tongue is then attached to upper surface 164 of the beam, and the panel is thereby attached to the beam via the insert and tongue interlock. If the panel and beam move vertically with respect to each other, the tongue slides in slot 90 to accommodate this relative movement while the panel remains securely affixed to the beam. The means and method for attaching the tongue to the beam will be more fully discussed below.

As shown in FIGS. 3 and 6, the bottom inserts 10' are connected to the footing 14 via tie clamps 196 which each includes a clamp plate 200 having a first planar portion 202 and a second planar portion 204 offset from each other and connected together by a connecting portion 206.

Figure 9:
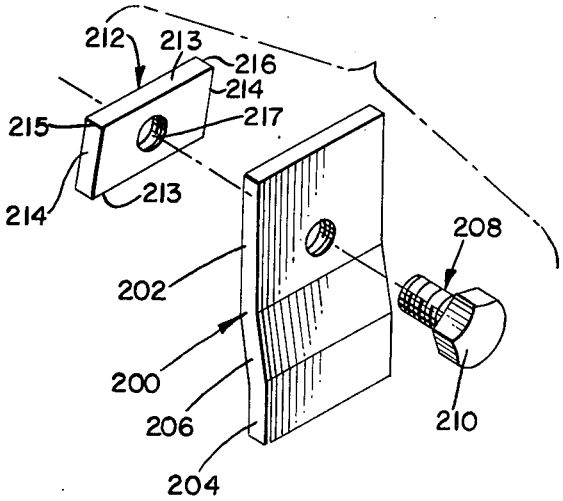
FIG. 9 is an exploded perspective showing a clamp assembly embodying the teachings of the present invention.

As shown in FIG. 9, the clamp includes a bolt 208 having a bolthead 210 on one end thereof and a wedge nut, or jam nut, 212 on the other end thereof. The jam nut has first sides 213 and second sides 214. As shown in FIG. 9, the sides 214 are sloped with respect to the sides 213 to form corners 215 and 216. The jam nut has a threaded bolt receiving hole 217 defined centrally thereof for threadably receiving bolt 208. The width of the jam nut, as measured between the sides 213, is selected to permit insertion of the jam nut into a panel-mounted housing, and thereby permit insertion of the clamp as a unit in a panel-mounted housing. The jam nut jams itself against the walls of the housing chamber as the bolt is tightened. Alternatively, the FIG. 9 clamp is also suitable for use with a heavy duty housing having outwardly presented legs, as above-described.

As is evident from the foregoing description, the clamp fastener is attached securely to the housing, and any movement of the panel relative to a building occurs between the building structure and the clamp, rather than a moving connection of the clamp tie to the housing which would be similar to the moving connection between the tongue elements and the housing.

The clamp plate 200 is attached to the insert to be outwardly dependent therefrom as shown in FIG. 3 so that a slot 220 is defined between the insert side member legs outer surfaces and the undersurface of the tie clamp.

A right angle bracket 230 has a base 232 and a back 234 and is base mounted on the footing 14 so the back 234 extends upwardly therefrom and has the back surface 236 thereof located to be flushly engaged against panel inner surface 240 as shown in FIG. 3. The back 234 has an upper edge which is received in the slot 220 as shown in FIG. 3 and has a thickness which permits a jamming engagement of the back 234 in the slot 220.

Figure 7:
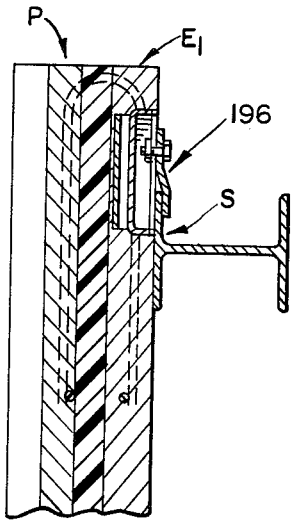
FIG. 7 is an elevation view of a clamp fastener located at the top of a panel.

A clamp located at the top of a panel is shown in FIG. 7, and a sliding plane is illustrated in FIG. 7 by the numeral S.

Figure 8:
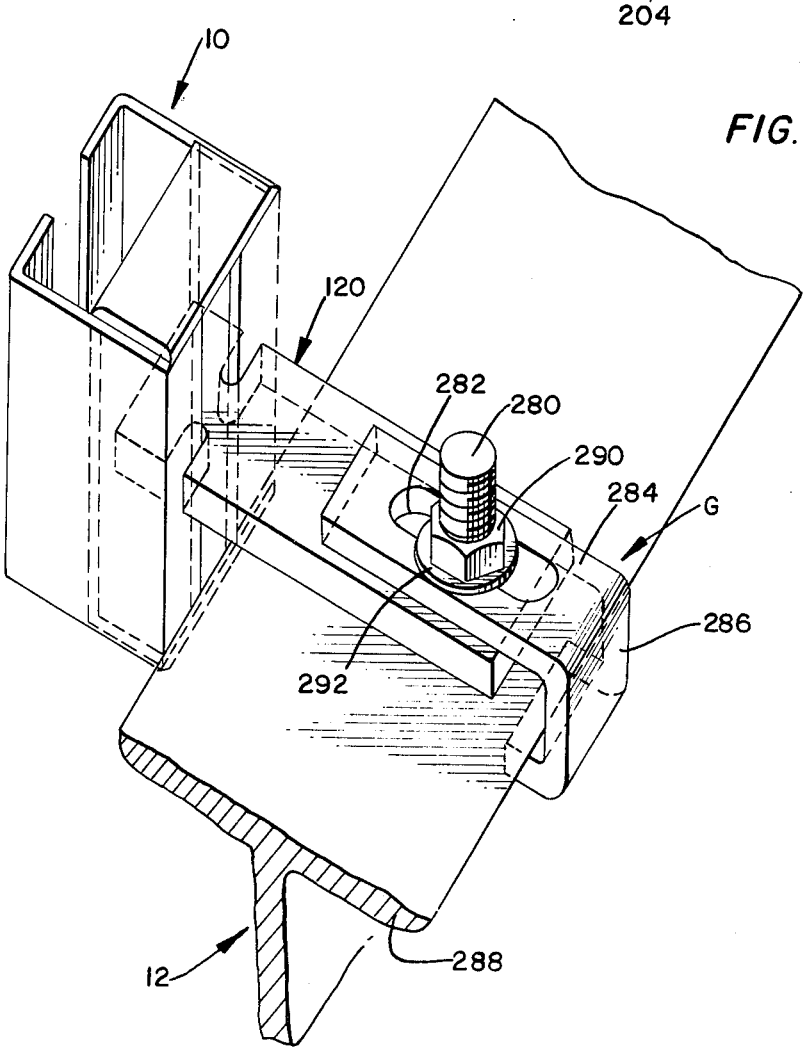
FIG. 8 is an isometric view of a clamp for connecting a tongue to a panel.

In operation, the panels are attached to a building via the inserts by attaching the tie clamps 196 of the bottom inserts and setting up the panels with the brackets jammed into the bottom inserts. The tongues for the top inserts are inserted into the top inserts and attached to the beams either by a temporary fastening means, such as a temporary bolt 280 pre-welded to the tongue 120. The bolt is used to fasten a variety of clamps, such as a clamp G, or the like to the tongue in order to suit the shape and location of particular building structural or use as a temporary connection. When this connection is used on a structure, for example, on a double-T structure, the slotted hole is provided in the tongue to receive a bolt from a slotted insert embedded in a double-T flange at right angles to the tongue. The slotted insert in the double-T flange provides for construction tolerance in the longitudinal direction, whereas the slot in the tongue provides for tolerance in the lateral direction. It is noted that the main purpose of the insert is to permit vertical movement between the panels and the structure regardless of the structure, and these attachment variations simply accommodate the particular structure supporting the panels and provide for erection tolerances. The clamp G can include set screws, or other such means of attaching the tongue element to the building structurals such as a flange of an I-beam, such as beam 12 shown in FIG. 3. A suitable clamp is shown in FIG. 8, and, as shown in FIG. 8, the bolt 280 which is fastened to the tongue is received in a slot 282 defined in clamp body 284. The clamp has a head 286 which fits on top edge 288 of the beam 12, and a locking nut 290 and washer 292 are used to secure the clamp and tongue to the beam. Once set properly, the tongues are welded to the beam top surface as indicated by the numeral 250 in FIG. 4, and the clamp G is removed and can then be reused. It is also noted that there are other ways of attaching the structures. These other methods are not disclosed herein for the sake of convenience, but will not depart from the scope of the present invention.

In one preferred form of the insert, the overall width of the insert, as measured between the side member legs, is about 2½ inches, the width of each of the side member legs, as measured between the bight 24 and edge 32, is about 15/16 inch, and the length of the insert, as measured between the end edges of the side members, in one form is 4 inches, and in another form is 6 inches. In such form, the widths of the chamber 100 as measured between the front face 76 and the inner surface of the spacer bight section is about $1\frac{1}{4}$ inches. The width of the slot 90 is about $1\frac{1}{8}$ inches, thereby defining an overall width of the insert as measured between the outer faces of the side member bight sections of about $2\frac{7}{8}$ inches. Preferably, the members all have thicknesses of about 3/16 inch.

In a preferred form, the tongue has an overall length of about 6 inches, an overall width of about $2\frac{1}{4}$ inches, thereby providing a clearance of about $\frac{1}{4}$ inch between the tongue and the inner surface of the side member bight sections. The tongue preferably has a thickness of about $\frac{1}{2}$ inch. The slots 136 and 138 are each about 11/16 inch long thereby leaving a space of about $\frac{7}{8}$ inch between the aligned slots so that a clearance of about $\frac{1}{8}$ inch is defined between the tongue and the slot 90 for allowing vertical movement of the tongue in the slot 90. The slots are set back about $\frac{3}{4}$ inch from the tongue end edge 122 as measured between edge 122 and leading edge 144 of the slots, and are about $\frac{1}{4}$ inch wide to allow sliding of the slots on the side member legs.

The inserts embodying the teachings of the present invention can be used in solid or insulated panels and can develop the forces required with anchors no deeper than $2\frac{1}{2}$ inches, and can withstand pullout forces close to 10,000 pounds per insert (based on the above dimensions). It is noted that the tongue-type connection which has a pull-out capacity of about 10,000 pounds is more satisfactory for horizontal seismic forces than is the clamp attachment. The clamp attachment is satisfactory for high action loads.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. An attaching means for attaching wall panels to a building comprising:

a plurality of first inserts mounted in a wall panel near one end thereof;

a plurality of second inserts mounted in such wall panel near another end thereof which is remote from said one end;

said inserts each including elongate chamber defining means defining a first chamber for accommodating concrete, said chamber having open ends so concrete can flow freely therethrough and thereinto for securely mounting said each insert in a wall panel, said chamber defining means including a pair of opposed U-shaped side members each having one leg thereof extending toward the other side member and located to be essentially coplanar with one leg of the other side member and spaced apart therefrom to define said elongate slot between said one legs, and elongate slot defining means on said each insert;

a partition mounted in each of said inserts and including means for separating said first chambers from said slot and defining a slot chamber which is essentially isolated from said first chamber and which remains essentially free of concrete, said partition being U-shaped and having the legs thereof connected to said side member one legs so that said chamber is defined by said one legs, said partition and portions of said side members;

a plurality of tongue elements each having tongue slots defined therein near one end thereof, said tongue slots having rounded bottom edges and slidably engaging an elongate slot defining means of one of said first inserts with said tongue one ends being received in one of said first insert slot chambers so that said each tongue is slidably connected to said one insert with the other ends thereof projecting outwardly therefrom, a tongue clamp element on each tongue connecting the other end of said each tongue to a building to connect a panel to such building with the sliding engagement between said each tongue and said first insert allowing relative vertical movement between a building connected panel and the building to which such panel is connected, said tongue clamps including a head for fitting over a beam and locking means attaching each tongue clamp to a tongue;

a plurality of bottom clamp elements each associated with one of said second inserts and each including a fastening means secured to one of said second inserts, mounting means on a building, said each bottom clamp element fastening means being slidably engaged with said mounting means to connect a panel to a building such that relative movement between a building connected panel and the building to which such panel is connected is permitted.

2. The attaching means defined in claim 1 wherein said insert side members each further includes a second leg located to be essentially coplanar with a second leg of the other side member, said second legs being spaced from said spacer member so that a passage is defined by said spacer member, said second legs and other portions of said side members.

3. The attaching means defined in claim 1 further including a bracket attached to a building and having an upstanding portion, said clamp receiving said bracket upstanding portion.

4. The attaching means defined in claim 3 further including means for temporarily attaching said tongue elements to a building while a panel is being positioned.

5. The attaching means defined in claim 1 wherein said bottom clamp elements each includes a clamp plate, a wedge nut and a fastener attaching said wedge nut to said clamp plate, said wedge nut being received in a housing and being jammed against said housing when said fastener is tightened to securely attach said clamp plate to said housing.

6. The attaching means defined in claim 5 wherein said mounting means includes a bracket attached to a building and slidably engaging said clamp plate so that movement between a panel and a building occurs between such building and said clamp plate.

7. The attaching means defined in claim 6 wherein said tongue clamp elements are located near a top edge of an upright panel.

8. The attaching means defined in claim 6 wherein said bottom clamp elements are located near a bottom edge of an upright panel.

* * * * *